US005462640A

United States Patent [19]

Stark et al.

[11] Patent Number: 5,462,640

[45] Date of Patent: Oct. 31, 1995

[54] ETCHING SOLUTION

[75] Inventors: Walter Stark, Forchheim; Robert Ruprecht, Walzbachtal, both of Germany

[73] Assignee: Kernforschungszentrum Karlsruhe GmbH, Karlsruhe, Germany

[21] Appl. No.: 962,801

[22] PCT Filed: Apr. 21, 1992

[86] PCT No.: PCT/DE92/00321

§ 371 Date: Dec. 22, 1992

§ 102(e) Date: Dec. 22, 1992

[87] PCT Pub. No.: WO92/19792

PCT Pub. Date: Nov. 12, 1992

[30] Foreign Application Priority Data

Apr. 24, 1991 [DE] Germany ..... 41 13 283.1

[51] Int. Cl.[6] ..... C09K 13/00; C23F 1/00

[52] U.S. Cl. ..... 216/103; 252/79.2; 252/79.4; 252/79.5; 216/108

[58] Field of Search ..... 156/664, 665; 252/79.2, 79.4, 79.5; 134/2, 3

[56] References Cited

U.S. PATENT DOCUMENTS

| | | | |
|---|---|---|---|
| 2,698,781 | 1/1955 | Meyer . | |
| 3,666,580 | 5/1972 | Kreml et al. . | |
| 4,004,956 | 1/1977 | Brindisi, Jr. . | |
| 4,548,903 | 10/1985 | Weiss et al. | 156/664 X |
| 4,619,707 | 10/1986 | Hirschmeier et al. . | |
| 4,687,545 | 8/1987 | William et al. | 156/664 X |
| 5,035,749 | 7/1991 | Haruta et al. . | |

FOREIGN PATENT DOCUMENTS

| | | |
|---|---|---|
| 0161387 | 11/1985 | European Pat. Off. . |
| 0413261 | 2/1991 | European Pat. Off. . |
| 2281998 | 3/1976 | France . |
| 2013149 | 10/1970 | Germany . |
| 2143785 | 3/1972 | Germany . |
| 2635295 | 2/1977 | Germany . |
| 3248006 | 7/1983 | Germany . |
| 10396 | 2/1981 | Japan . |
| 394761 | 12/1965 | Switzerland . |
| 8707917 | 12/1987 | WIPO . |

OTHER PUBLICATIONS

Sensors and Actuators A, 25–27 (1991), 559, 563 C. Burbaum et al.: "Fabrication of Captive . . . ".

S. Hirsch et al.: "Stripping Metallic Coatings".

*Primary Examiner*—Thi Dang

*Attorney, Agent, or Firm*—Spencer, Frank & Schneider

[57] ABSTRACT

An etching solution for etching away a metal layer from a substrate includes a hydrogen-containing compound that dissolves the metal layer while developing hydrogen; and a nitrosubstituted organic compound having a nitro group which is easily hydratable and which has at least a ⅓ nitro group equivalent per mole of the hydrogen developed by reaction between the hydrogen-containing compound and the metal layer until the metal layer is dissolved completely. A method for etching employs the etching solution into which the substrate is immersed. The process of preventing the release of hydrogen gas during the etching away of a metal layer from a substrate is taught and includes employing an etching solution containing one of an acid or a highly basic metal hydroxide; and adding to the etching solution an organic nitro compound which is soluble in water and which is easily hydratable.

4 Claims, No Drawings

ETCHING SOLUTION

BACKGROUND OF THE INVENTION

1. Field of the Invention

The invention relates to an etching solution for etching away a metal layer from a substrate which includes a hydrogen containing compound that dissolves the metal per se while developing hydrogen, and a nitrosubstituted organic compound, to a method for etching away a metal layer from a substrate wherein the substrate coated with the metal is immersed into an etching solution which contains a hydrogen containing compound that dissolves the metal per se while developing hydrogen, and includes a nitro substituted organic compound, preamble of the eighth claim and to the use of a water soluble, easily hydratable organic nitro compound as an addition to the aqueous solution of an acid or a highly basic metal hydroxide in order to prevent the release of hydrogen gas when metal is dissolved in the solution.

2. Description of the Related Art

An etching solution and a process of this type are disclosed in DE 3,248,006.A1. One subject of this publication is an agent for the selective removal of hard metal surface coatings, particularly ceramics, cermets and mixtures based on nickel from high strength, high temperature resistant substrates. This agent is characterized by approximately 90 to 450 g/l $H_2SO_4$, approximately 20 to 240 g/l of a water soluble, nitrosubstituted aromatic compound, the remainder water. The publication further relates to a process for removing hard metal surface coatings by employing this agent.

The water soluble, nitrosubstituted aromatic compound is preferably composed of m-nitrobenzene sodium sulfonate or m-nitrobenzene sodium sulfonic acid or the corresponding alkali or earth alkali metal nitrobenzene sulfonates; however, the other organic nitro compounds mentioned in U.S. Pat. No. 2,698,781, which will be discussed below, can also be employed.

The etching solution may additionally include hydrofluoric acid, fluoboric acid $HBF_4$ and surfactants as wetting agents.

The publication does not reveal the manner in which the described etching solution works. The nitroaromatic compound is merely called an oxidation agent.

During practical tests with the prior art etching solution employing a sulfuric acid concentration of (i) 90 g/l, (ii) 300 g/l and (iii) 450 g/l, together in each case with 240 g/l m-nitrobenzene sodium sulfonate, it was found that hydrogen developed and was released. The etching solution was very viscous and could be employed only at an elevated temperature. Accordingly, the etching process disclosed in the publication is implemented at a temperature between about 49° C. and 82° C.

Another etching solution of the above-mentioned type is disclosed in the already cited U.S. Pat. No. 2,698,781. In the simplest case, this etching solution is composed of an acid and a nitrosubstituted aromatic compound whose potential under special conditions mentioned in the publication lies between 0.50 Volt and 0.90 Volt. In this etching solution, the nitrosubstituted aromatic compound is not used up during the etching process or only to a slight extent; it acts as an activator or catalyst for the etching reaction. Thus—although this is not explicitly mentioned in the publication—hydrogen has to form during the etching process. Due to the condition that the potential of the nitrosubstituted aromatic compound is to lie in the stated range, it is obvious that the compounds selected from this class of compounds are those which, after the etching process, form a reaction product neither with the metal nor with the developing hydrogen. The m-nitrobenzene sulfonic acid specially preferred in the above-mentioned DE 3,248,006.A1 is mentioned as one of the nitrosubstituted aromatic compounds that have such a potential.

Further etching solutions containing additional components are disclosed, for example in the publications CH 394,761, DE 2,635,295.C2, DE 2,536,404.C2 and DE-OS [Unexamined Published Patent Application] 2,143,785.

CH 394,761 relates to a mixture for the selective dissolution of a metal in the presence of a second metal on which the first metal is precipitated. This process is characterized in that it includes an organic nitro compound and an ammonium compound that is free from nitro groups, with the mixture being liquid and containing at least 0.01 weight % of the organic nitro compound and the ammonium compound together and having a pH value of 7 to 11. The reference further relates to a method of producing the mixture and its use for the removal of a galvanic metal coating from a metal object that is coated with it.

Aromatic nitro compounds such as, for example, the already repeatedly mentioned nitrobenzene sulfonic acid, but also nitroaliphatic compounds such as nitromethane or nitroethane may be employed as organic nitro compounds.

Although the mixture is a base, it must in no case include a strong base, such as alkali hydroxide; this is understandable because strong bases would release ammoniac from the ammonium compounds. Moreover, the concentration of hydroxyl ions should be relatively low.

DE 2,635,295.C2 discloses an etching solution for metals composed of a nitrosubstituted organic compound, a phosphorus oxyacid derivative, an organic polyamine and an added acid or base to set a pH value between 6 and 14. The metals are attacked by the nitro compound; the phosphorus oxygen derivatives form complexes of the released metal ions.

The publications DE 2,536,404.C2 and DE-OS 2,143,785 disclose even more complicated etching solutions.

These references do not indicate whether hydrogen forms from the use of these etching solutions or whether the release of hydrogen is suppressed.

The publication entitled "Fabrication of Capacitive Acceleration Sensors by the LIGA Technique" by C. Burbaum, J. Mohr, P. Bley and W. Ehrfeld, presented at the "Conference Eurosensors 4", Oct. 1–3, 1990, Karlsruhe, printed publication scheduled under the same title, discloses the use of aqueous hydrofluoric acid solution as the etching solution. The publication relates to processes for manufacturing microstructures having great structural heights in which a sacrificial layer is selectively etched away so that cantilever-type structures are created which adhere only partially to the substrate. These structures can be employed as acceleration sensors. The aqueous solution of hydrofluoric acid is employed as the etching solution. With this etching solution, a titanium layer can be selectively etched away with respect to a nickel, copper or gold layer.

As described, for example, in the last-mentioned publication, etching solutions are frequently employed in the microstructuring art in order to selectively etch away thin metal layers from other metals and creating, for example, cantilever-type or complex shaped filigree microstructures whose size often lies in a range below one hundred micrometers, approximately in a range between 5 and 10

μm. It is of course understood that such microstructures may be mechanically very sensitive. In order for the thin layers to be etched away, which are often disposed at the bottom of microrecesses, to be wetted by the etching solution, the solutions employed must have a very low viscosity.

Hydrogen develops at least if etching solutions of the above-mentioned type are employed. The formation of hydrogen in the treatment of microstructured substrates is a drawback for several reasons. The formation of gas bubbles may lead to mechanical damage or deformation of the filigree microstructures. In addition, it is often necessary to optically follow the etching process very precisely and to monitor it. However, the development of hydrogen at least impedes the ability to observe, often it even makes it impossible.

It is an object of the invention to propose etching solutions and etching processes of the above-mentioned type which contain an acid or a strong base that attacks the metal and dissolves it by forming the corresponding metal ions, in which, however, the development of hydrogen is prevented or at least considerably reduced and which can therefore also be employed in the microstructuring art. In this case, however, the selective effect of the attacking agent in the etching solution should not be impaired.

SUMMARY OF THE INVENTION

This is accomplished by the invention, based on the above-mentioned etching solutions and processes, by the etching solutions and processes defined in greater detail in the characterizing portions of claims 1 and 8. The further claims define special embodiments of the etching solutions according to the invention and the above-described use.

The invention solves the problem on which it is based in that the etching solution includes such a nitrosubstituted organic compound whose nitro group easily reacts with nascent hydrogen and is thus easily hydrated, with special concentration conditions preferably being maintained.

The attacking agent in the etching solution according to the invention is usually an acid or an aqueous solution of the acid. Since the substrate from which a metal layer is to be etched away is frequently also made of metal, the acid selected is such that it dissolves the metal layer but not the substrate. In the microstructuring art, a diluted aqueous hydrofluoric acid solution is frequently employed as the acid with which, for example, titanium metal can be selectively etched away from nickel. In principle, many other inorganic or organic acids can be employed as the attacking agent, such as, for example, hydrochloric acid, sulfuric acid, formic acid, acetic acid, etc. If a metal layer is to be selectively etched away, an acid is selected which quickly dissolves the metal layer but does not attack the substrate or at least attacks it significantly slower. When pure acids act on the metal layer, hydrogen is developed.

However, the invention is not limited to acids as the attacking agent. Some metals, such as, for example, aluminum, are also dissolved by highly basic metal hydroxides such as, for example, sodium hydroxide or potassium hydroxide or their aqueous solutions. This opens up a further possibility to selectively etch away a metal layer from a further metal. Hydrogen also develops if metal is etched away by means of a pure base.

Further hydrogen containing compounds which dissolve metals per se while developing hydrogen are proton-releasing organic compounds such as, for example, alcohols.

As the tests leading to the invention have shown, some organic nitro compounds according to the following formula:

$$R—NO_2+3\ H_2 \rightarrow R—NH_2+2\ H_2O \quad (1)$$

(where R- identifies any desired organic radical) are able to react with nascent hydrogen.

According to this reaction, the hydrogen generated under the influence of pure acids or bases on a metal can be collected so that, if an etching solution is employed which contains organic nitro compounds in addition to acids or bases, the development of gas bubbles that is damaging to the microstructures will not occur.

Nitrosubstituted organic compounds that react quickly according to Reaction Equation 1 with nascent hydrogen are called easily hydratable compounds.

Reaction Equation (1) indicates that at least ⅓ mole of an easily hydratable, monosubstituted nitro compound must be present in the etching solution in order to be able to collect one mole hydrogen. However, two or more times nitrosubstituted organic compounds may also be employed in the same manner. If the nitro group contains two (generally x) nitro groups, only ⅙ mole (corresponding to ⅓·x mole) of the nitro compound is required to collect all of the hydrogen developing during the reaction. Preferably the hydrogen developed per mole during the dissolution of metal should be present in the etching solution to at least ⅓ of the nitro group equivalent.

In principle, preliminary tests can be employed to determine in a simple manner which organic nitro compounds are easily hydratable since it is merely necessary to determine whether they are able to collect the hydrogen developed during the action of an acid or a highly basic hydroxide on metal. Such easily hydratable organic nitro compounds may also be employed in combination with other acids or hydroxides.

Easily hydratable organic nitro compounds are, for example, short-chained nitroaliphatics, particularly nitromethane which is particularly preferred because of its high solubility in water, but also nitroethane or nitropropane. From the group including the nitroaromatic compounds, the nitrophthalic acids, for example 4-nitrophthalic acid, and picric acid are particularly suitable.

If the solubility of the organic nitro compound in water should turn out to be too low, a solubilizer, for example a short chained alcohol, such as methanol, can be mixed into the etching solution according to the invention.

The aromatic nitro compounds listed in the above-cited U.S. Pat. No. 2,698,781, particularly also the m-nitrobenzene sodium sulfonate and the corresponding sulfonic acid or its other salts preferred according to the above-mentioned DE 3,248,006.A1, are definitely not suited for the production of the etching solution according to the invention. As is evident from Example 2 of U.S. Pat. No. 2,698,781, m-nitrobenzene sulfonate is not converted during the dissolution of nickel by sulfuric acid; the corresponding m-nitrobenzene sulfonic acid remains behind. This also makes it clear that hydrogen is released if the etching solution disclosed in DE 3,248,006.A1 is employed.

During the hydration of nitromethane, the following reaction takes place:

$$CH_3NO_2+3\ H_2 \rightarrow CH_3NH_2+2\ H_2O \quad (2)$$

Thus, at least 1 mole (61 g) nitromethane is required to collect 3 mole hydrogen.

The etching away of titanium and aluminum with hydrofluoric acid takes place according to the following reaction equations:

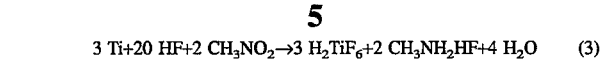

$$3\ Ti+20\ HF+2\ CH_3NO_2 \rightarrow 3\ H_2TiF_6+2\ CH_3NH_2HF+4\ H_2O \quad (3)$$

3·47.9 g 400 g 2·61 g

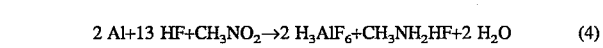

$$2\ Al+13\ HF+CH_3NO_2 \rightarrow 2\ H_3AlF_6+CH_3NH_2HF+2\ H_2O \quad (4)$$

2·27 g 260 g 61 g

The quantity of hydrogen that would be released is a function of the charge of the resulting metal ions. The stoichiometric equations indicate only the minimum quantities. In practice it is necessary to work with an excess of acid (or base) as well as with an excess of the nitro compound so that the etching rate does not change significantly even toward the end of the etching process. For the oxidation of the hydrogen which develops during the etching process in different stoichiometric quantities, depending on the valency of the metal to be etched, at least the molar quantities of nitro compounds corresponding to the reaction equations must be present to prevent the development of hydrogen gas. However, it is advisable to work with at least two to three times the stoichiometric quantity of nitro compounds so that the nitro compound is always present in a stoichiometric excess.

During the oxidation of hydrogen by means of the nitro compound, the amine compound is formed in the acid etching medium which is then present as an ammonium salt due to salt formation with the acid.

In the acid etching medium, that is, in combination with an acid, aliphatic nitro compounds are preferred as the easily hydratable nitro compounds.

It is further preferred to work with relatively low acid concentrations, for example with 5-normal, better yet, with 2.5 normal acids. For example, hydrofluoric acid should be employed in a concentration of no more than 10 weight %. With higher concentrations it is not possible to completely suppress the development of hydrogen.

For alkali etching solutions, aromatic nitro compounds are preferred, because in alkali etching solutions nitroaliphatics having an alpha-location H atom are able to form salts due to their C—H—acid characteristics and in this way cause secondary reactions. Due to the absence of C—H—acid hydrogen, these secondary reactions can be excluded, for example, in connection with nitrophthalic acids. However, due to the high stability of individual intermediate products up to the amine as the end product, secondary reactions must be expected in the alkali range so that the reaction need not necessarily continue until the amine is formed. Rather, azo-oxyaromatics, azo-aromatics or hydrazone aromatics may also be produced. Since, in that case, less hydrogen is bound, an even higher excess of aromatic nitro compounds should preferably be employed in connection with alkali etching solutions.

The positive characteristics of the etching solution according to the invention can be further improved if additionally a wetting agent is added. The addition of the wetting agent reduces the surface tension of the etching solution relative to the metal to be etched. This is of advantage particularly if very fine structures are to be etched free. In cases in which the easily hydratable organic compound is unable to completely suppress the formation of hydrogen due to insufficient solubility or insufficient reaction speed of the hydration, the addition of a wetting agent brings the result that the gas bubbles are smaller, adhere less well to the surface and therefore are more easily removed from the solution. Suitable wetting agents are, for example, polyethylene glycol or lauryl sulfate.

The advantage of the invention is that the hydrogen formation during etching can be prevented by simple means or at least reduced considerably. Therefore the etching process takes place more gently so that even substrates provided with sensitive microstructures can be etched without damage or deformations. The etching process remains observable during the entire etching time so that the etching process can be monitored optically—if necessary also under a microscope—and can be interrupted if necessary. Moreover, the process according to the invention is advantageous for safety reasons since the release of hydrogen is prevented. Another advantage of the etching solution according to the invention is that no gas bubbles will coat the metal layers to be etched away, thus permitting the etching process to take place more uniformly and quickly. The occurrence of pitting is prevented. Finally, the customarily employed agent (acid or strong base) to attack the metal can continue to be used; it is merely necessary to add the easily hydratable organic nitro compound. The prior art, selectively acting dissolving characteristics of the agent remain in effect. The surfaces that are etched away according to the invention are smoother and shinier than if no nitro compounds had been added.

DESCRIPTION OF THE PREFERRED EMBODIMENTS

The invention will now be described in greater detail with reference to examples thereof.

1. Examples For Etching With An Etching Solution Composed Of An Aqueous Solution Of Hydrofluoric Acid And Nitromethane As The Easily Hydratable Organic Compound (a) Etching tests were conducted with six ultracut small copper plates that were covered with a titanium layer of a thickness of approximately 10 μm, with it being the intention to selectively etch away the titanium layer. Hydrofluoric acid solutions of different concentrations were employed and the etching times were measured. The following etching solutions were used:

25 ml of a 10% hydrofluoric acid solution and 2 ml nitromethane;

25 ml of a 5% hydrofluoric acid solution and 2 ml nitromethane;

250 ml of a 1% hydrofluoric acid solution and 10 ml nitromethane;

250 ml of a 1% hydrofluoric acid solution and 2 ml nitromethane.

As wetting agent, 4 ml polyethylene glycol 400 were added per 100 ml etching solution.

No noticeable hydrogen development during dissolution of the titanium layer was noted in any of the cases. Only with the 10% hydrofluoric acid solution was there a very slight development of hydrogen at certain locations. The etching speed increased with increasing content of hydrofluoric acid. The etching speed could be noticeably accelerated by stirring the etching solution, particularly where highly diluted solutions were involved. In the case of the 1% hydrofluoric acid solutions, it was doubled by stirring (100 revolutions per minute by means of a magnetic stirring rod). Stirring helped, on the one hand, to supply sufficient nitromethane to the titanium surface to be etched, on the other hand, local overheating due to the exothermal reaction was avoided.

(b) A cantilever-type microcoil was produced with the etching solution according to the invention by selectively etching away titanium that was disposed between the copper coil turns on the aluminum oxide ceramic. The etching solution employed was 250 ml of a 1.25% hydrofluoric acid solution to which 18 ml nitromethane and 10 ml polyglycol-400 had been added as wetting agent. The etching process could be monitored optically since no hydrogen developed.

The titanium was selectively etched away from the copper.

(c) Etching tests were made with a 5% and a 10% hydrofluoric acid solution. Small aluminum plates weighing approximately 280 mg of a size of approximately 9×9 mm served as substrates.

10% Hydrofluoric Acid Solution:

The etching solution was composed of 50 ml of the hydrofluoric acid, 4 ml nitromethane and 4 ml polyethylene glycol-400. A magnetic stirring rod was used at 500 rpm for stirring.

If the plate was dipped into the non-stirred etching solution, a small amount of hydrogen developed in the form of very fine gas bubbles which, however, did not considerably impede the optical monitoring of the etching process. As soon as the stirrer was switched on, the formation of gas bubbles ceased. The time until the plate was completely dissolved was 4 hours.

5% Hydrofluoric Acid Solution:

A mixture of 100 ml of the acid, 8 ml nitromethane and 8 ml polyethylene glycol-400 was employed as the first etching solution. For comparison purposes, a second etching solution was employed which, however, did not contain any nitromethane.

With the 5% hydrofluoric acid solution as well, a slight hydrogen development took place in the non-stirred etching solution containing nitromethane but, as soon as the stirrer was switched on, it disappeared.

However, in the etching solution without nitromethane, hydrogen began to develop very violently at once so that the etching solution took on a milky, turbid appearance and it was no longer possible to accurately observe the etching process. Due to the development of hydrogen, the substrate did not remain quietly at rest but was constantly moved strongly back and forth.

As a whole, two etching tests were made with a nitromethane containing etching solution and with an etching solution free of nitromethane. It was then found that the etching speed in the nitromethane containing solution is greater than in the solution free of nitromethane. Probably the metal surface in the nitromethane free solution is constantly covered at least partially with gas bubbles and is thus removed from the attack of the etching solution.

2. Examples For Etching With Etching Solutions Composed Of Mineral Acids And Nitromethane As The Easily Hydratable Organic Compound (a) Etching Solution Containing Hydrochloric Acid Composition of the etching solution: 120 ml of an 8% hydrochloric acid solution and 8 ml nitromethane.

A steel pin weighing 732 mg was etched under stirring for approximately 20 hours. No hydrogen development was visible during the etching process. During the stated time, 364 mg steel were etched away.

Comparison Test With The Etching Solution Of (a) But Without The Addition Of Nitromethane Right at the beginning, a weak hydrogen development began. The etching speed was much slower: after 20 hours only 28 mg steel were etched away; after 100 hours, 191 mg were etched away, with pitting being observed, however.

(b) Etching Solution Containing Nitric Acid Composition of the etching solution: 100 ml water, 5 ml concentrated nitric acid, 8 ml nitromethane.

A steel pin was dissolved within one hour without noticeable hydrogen development.

Comparison Test With The Etching Solution Of (b) But Without The Addition Of Nitromethane The dissolution took somewhat longer but with constant hydrogen development.

(c) Etching Solution Containing Sulfuric Acid

Composition of the etching solution: 100 ml of a 3.5% sulfuric acid solution and 8 ml nitromethane.

A steel pin was dissolved within 15 hours without hydrogen development.

Comparison Test With The Etching Solution of (c) But Without The Addition Of Nitromethane After 19 hours, only 35 mg of the steel pin were etched away with hydrogen development. Thus, nitromethane, particularly in diluted solutions, results in a greatly accelerated etching process.

3. Etching Tests In Aqueous-Organic Media And With Homologous Aliphatic And Aromatic Nitro Compounds (a) Etching Test With A Mixture Of Hydrochloric Acid/Glacial Acetic Acid And Nitromethane Composition of the etching solution: 85 ml glacial acetic acid, 10 ml concentrated hydrochloric acid, 15 ml nitromethane.

With this etching solution, a steel pin weighing 739 mg could be etched away very uniformly within a few days without hydrogen development.

(b) Etching Test With A Mixture Of Methanol/Hydrofluoric Acid And Nitroethane

Composition of the etching solution: 60 ml methanol, 16 ml of a 40% hydrofluoric acid solution and 5 ml nitroethane.

With this etching solution, an aluminum/lead alloy was etched without noticeable hydrogen development. At the beginning, a black coating formed on the metal surface which, however, disappeared in the further course of the dissolution process.

(c) Etching Test With Hydrofluoric Acid And Nitroethane

Composition of the etching solution: 80 ml of a 5% hydrofluoric acid solution, 3 ml nitroethane.

A piece of titanium wire weighing 270 mg was dissolved within about four hours without noticeable hydrogen development.

d) Etching Test With Hydrofluoric Acid And Nitropropane

Composition of the etching solution: 40 ml of a 5% hydrofluoric acid solution, 1 ml nitropropane.

A piece of titanium wire weighing 328 mg was dissolved within 5 hours. There was a noticeable development of hydrogen which was presumably caused by the insufficient concentration—due to the poor solubility of nitropropane—of the easily hydratable organic compound. As already mentioned, the concentration of nitropropane could be increased with the aid of solubilizers.

(e) Etching Test With Hydrofluoric Acid And 4-Nitrophthalic Acid

Composition of the etching solution: 40 ml of a 5% hydrofluoric acid solution, 3 g 4-nitrophthalic acid.

A piece of titanium wire weighing 338 mg was completely dissolved within 4 hours. Noticeable hydrogen development began during the etching process. However, the hydrogen development was significantly less than in a comparison solution which contained no 4-nitrophthalic acid. Moreover, the gas bubbles were significantly smaller. With increasing etching time, the color of the solution changed to light brown due to the development of reaction products.

(f) Etching Test With Sodium Hydroxide And 3-Nitrophthalic Acid

Composition of the etching solution: 4 g sodium hydroxide, 4 g 3-nitrophthalic acid and 80 ml water.

A small aluminum plate could be etched without noticeable hydrogen development. Within 2.5 hours, 90 mg aluminum were etched away. Right at the beginning, the color of the solution changed to blue due to the formation of so far unidentified reaction products and with increasing etching time it became dark blue.

(g) Etching Test With Sodium Hydroxide Solution And 4-Nitrophthalic Acid

Composition of the etching solution: 4 g sodium hydroxide, 4 g 4-nitrophthalic acid and 80 ml water.

From a small aluminum plate weighing 270 mg, 70 mg aluminum were etched way within 2.5 hours. No hydrogen formation was observed. With increasing etching time the initially colorless etching solution became yellow then brown.

What is claimed is:

1. A method of etching away a metal layer from a substrate, comprising:

providing an etching solution according to claim 1; and immersing the substrate coated with the metal layer into the etching solution for a time effective to etch away the metal layer.

2. The process of preventing the release of hydrogen gas during the etching away of a metal layer from a substrate, comprising:

employing an etching solution containing one of an acid or a highly basic metal hydroxide; and adding to the etching solution an organic nitro compound which is soluble in water and which is easily hydratable in order to prevent the release of hydrogen gas during dissolution of the metal layer in the etching solution.

3. An etching solution for etching away a metal layer from a substrate, comprising:

a hydrogen-containing compound which is a highly basic metal hydroxide and which dissolves the metal layer while developing hydrogen; and a nitrosubstituted organic compound which has a nitro group and which is easily hydratable.

4. The etching solution according to claim 1, wherein the nitrosubstituted organic compound is a nitroaromatic compound.

* * * * *

UNITED STATES PATENT AND TRADEMARK OFFICE

CERTIFICATE OF CORRECTION

PATENT NO. : 5,462,640

DATED : October 31, 1995

INVENTOR(S) : Walter Stark and Robert Ruprecht

It is certified that error appears in the above-indentified patent and that said Letters Patent is hereby corrected as shown below:

Column 10, line 16, (claim 4, line 1), change "1" to --3--.

Signed and Sealed this

Second Day of April, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,462,640

DATED : October 31, 1995

INVENTOR(S) : Walter STARK and Robert RUPRECHT

It is certified that error appears in the above-indentified patent and that said Letters Patent is hereby corrected as shown below:

The claims as renumbered follow:

1. An etching solution for etching away a metal layer from a substrate, comprising:
   a hydrogen-containing compound which is a highly basic metal hydroxide and which dissolves the metal layer while developing hydrogen; and
   a nitrosubstituted organic compound which has a nitro group and which is easily hydratable.

2. The etching solution according to claim 1, wherein the nitrosubstituted organic compound is a nitroaromatic compound.

3. A method of etching away a metal layer from a substrate comprising:
   employing an etching solution containing one of an acid or a highly basic metal hydroxide; and
   adding to the etching solution an organic nitro compound which is soluble in water and which is easily hydratable in order to prevent the release of hydrogen gas during dissolution of the metal layer in the etching solution.

4. The process of preventing the release of hydrogen gas during the etching away of a metal layer from a substrate comprising:
   employing an etching solution containing one of an acid or a highly basic metal hydroxide; and
   adding to the etching solution an organic nitro compound which is soluble in water and which is easily hydratable in order to prevent the release of hydrogen gas during dissolution of the metal layer in the etching solution.

UNITED STATES PATENT AND TRADEMARK OFFICE

CERTIFICATE OF CORRECTION

PATENT NO. : 5,462,640
DATED : October 31, 1995
INVENTOR(S) : Walter STARK and Robert RUPRECHT It is certified that error appears in the above-indentified patent and that said Letters Patent is hereby corrected as shown below:

Claim 1, line 1, change "1." to --3.--.

Claim 2, line 1, change "2." to --4.--.

Claim 3, line 1, change "3." to --1.--.

Claim 4, line 1, change "4." to --2.--.

Signed and Sealed this

Eighteenth Day of July, 2000

*Attest:*

*Attesting Officer*

Q. TODD DICKINSON

*Director of Patents and Trademarks*